US005269450A

United States Patent [19]

Popovich et al.

[11] Patent Number: 5,269,450

[45] Date of Patent: Dec. 14, 1993

[54] HAMMER-STRIKABLE, POWDER-ACTUATED, FASTENER-DRIVING TOOL

[75] Inventors: Michael S. Popovich, Schaumburg; Richard J. Ernst, Palatine; Edward D. Yates, Chicago, all of Ill.

[73] Assignee: Illinois Tool Works, Inc., Glenview, Ill.

[21] Appl. No.: 15,927

[22] Filed: Feb. 10, 1993

[51] Int. Cl.[5] ..... B25C 1/14

[52] U.S. Cl. ..... 227/10; 173/211

[58] Field of Search ..... 227/9, 10; 173/211

[56] References Cited

U.S. PATENT DOCUMENTS

| | | | |
|---|---|---|---|
| 3,494,125 | 2/1970 | Robinson | 227/10 |
| 3,860,161 | 1/1975 | Engstrom et al. | 227/10 |
| 4,025,029 | 5/1977 | Kostas et al. | 227/10 |
| 4,078,710 | 3/1978 | Galluzzi | 227/10 |
| 4,099,581 | 7/1978 | Maret et al. | 227/10 |
| 4,252,259 | 2/1981 | Brosius | 227/8 |
| 4,493,376 | 1/1985 | Kopf | 173/139 |
| 4,598,851 | 7/1986 | Kopf | 227/10 |
| 4,651,912 | 3/1987 | Hawkins | 227/8 |
| 4,830,252 | 5/1989 | Gottlieb et al. | 227/8 |
| 4,890,778 | 1/1990 | Hawkins | 227/10 |

*Primary Examiner*—Scott Smith

*Attorney, Agent, or Firm*—Schwartz & Weinrieb

[57] ABSTRACT

In a hammer-strikable, powder-actuated, fastener-driving tool, a breech block is mounted within a generally tubular body by several resilient shock absorber structures, each including an elastomeric grommet, an eyelet having a tubular portion surrounded by the grommet and an annular portion, a washer interposed between the annular portion and one end of the grommet, and a screw attaching the breech block to the body. The screw shank extends through the grommet. The screw head bears against the washer. The breech block mounts a firing pin, which is biased backwardly to a normal position, and to which a hammer-strikable button is connected. A barrel, mounted upon the body so as to be axially movable with respect thereto, has an elongate slot. A stud mounted upon the body extends through the slot. A washer disposed around the stud is biased against the barrel so as to impart frictional drag to the barrel.

20 Claims, 3 Drawing Sheets

HAMMER-STRIKABLE, POWDER-ACTUATED, FASTENER-DRIVING TOOL

TECHNICAL FIELD OF THE INVENTION

This invention pertains to improvements in a hammer-strikable, powder-actuated, fastener-driving tool. A first improvement provides a shock absorber structure mounting a breech block within a generally tubular body. A second improvement provides an annular washer biased to impart frictional drag on a barrel.

BACKGROUND OF THE INVENTION

Hammer-strikable, powder-actuated, fastener-driving tools are used commonly to drive fasteners, such as drive pins, into concrete, masonry, or steel structures. Such a tool derives its motive power from blank cartridges containing gunpowder.

Such tools are exemplified in Kostas U.S. Pat. No. 4,025,029, Brosius U.S. Pat. No. 4,252,259, Kopf U.S. Pat. No. 4,493,376, Hawkins U.S. Pat. No. 4,651,912, Gottlieb et al. U.S. Pat. No. 4,830,252, and Hawkins U.S. Pat. No. 4,890,778. Such a tool may have a tool body defining a handle, a breech block mounted within the tool body by means of screws received by the tool body, and a firing pin movable within the breech block over a range of firing pin movement. The firing pin is biased so as to be normally disposed in a dormant position at a back extreme of the range and is capable of being impelled to a firing position at a front extreme of the range when the firing pin or a structure connected to the firing pin is struck forcibly with a hammer.

Thus, when the firing pin causes a cartridge loaded into the tool to fire, a fastener is driven forcibly from a muzzle by means of a piston and a driving blade. Also, explosive forces are produced, which impart high stresses on the tool particularly where the tool body receives screws or other fasteners mounting the breech block within the tool body. As described below, this invention deals with such stresses in a novel, advantageous manner.

SUMMARY OF THE INVENTION

A first improvement provided by this invention may be advantageously embodied in a hammer-strikable, powder-actuated, fastener-driving tool comprising a tool body defining a handle, a breech block movably mounted within the tool body, and a firing pin movably mounted within the breech block. The breech block is not fixed within the tool body but is mounted within the tool body, near a back end of the tool body, so as to be axially movable over a relatively short range of breech block movement relative to the tool body. The firing pin is mounted within the breech block so as to be axially movable over a substantially longer range of firing pin movement relative to the breech block. The firing pin is biased so as to be normally disposed in a dormant position at a back extreme of the range of firing pin movement. The firing pin is capable of being impelled to a firing position at a front extreme of the range of firing pin movement when the firing pin or a structure connected to the firing pin, near the back end of the tool body, is struck forcibly as by a hammer.

According to the first improvement, a shock absorber structure is disposed within the tool body to absorb high stresses imparted between the breech block and the tool body when a cartridge loaded into the tool is fired by the firing pin. As will be described in detail, the stresses are absorbed through resilient means permitting the breech block to move rearwardly a short distance relative to the tool body when the tool is fired. The resultant reduction in stresses enhances tool life. The shock absorber structure also absorbs recoil when the tool is fired, thus providing more comfort to the user.

A second improvement provided by this invention may be advantageously embodied in a hammer-strikable, powder-actuated, fastener-driving tool comprising such a tubular body, such a breech block, and such a firing pin, along with a barrel or muzzle mounted upon the tool body so as to be axially movable toward and away from the breech block. The barrel has an elongate slot extending axially. Also, a stud is mounted upon the tubular body so as to extend radially into the barrel, through the elongate slot.

According to the second improvement, an annular washer is disposed around the stud so as to bridge the elongate slot. Moreover, the annular washer is biased against the barrel so as to impart frictional drag on the barrel. Thus, although the barrel continues to be axially movable toward and away from the breech block, frictional drag imparted by the annular washer on the barrel retards axial movement of the barrel relative to the tool body.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts throughout the several views, and wherein.

DETAILED DESCRIPTION OF PREFERRED EMBODIMENT

Figure 1:
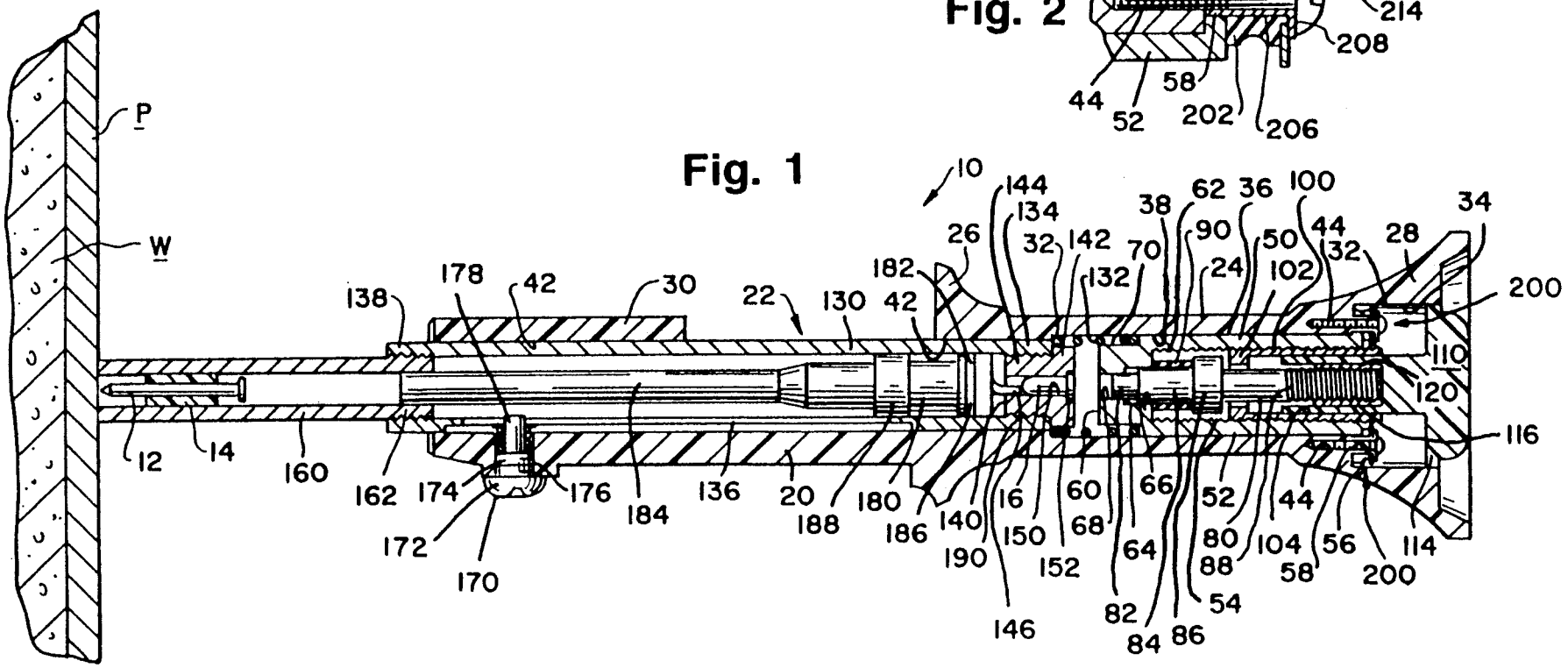
FIG. 1 is a longitudinal, sectional view of a hammer-strikable, powder-actuated, fastener-driving tool embodying the first and second improvements provided by this invention. The tool is shown in an initial stage wherein the tool is about to drive a drive pin through a hole in a metal workpiece and a concrete wall, before the tubular muzzle is pressed against the metal workpiece with sufficient force to overcome a coiled spring and to move the barrel from an intermediate position to a retracted position.
Figure 3:
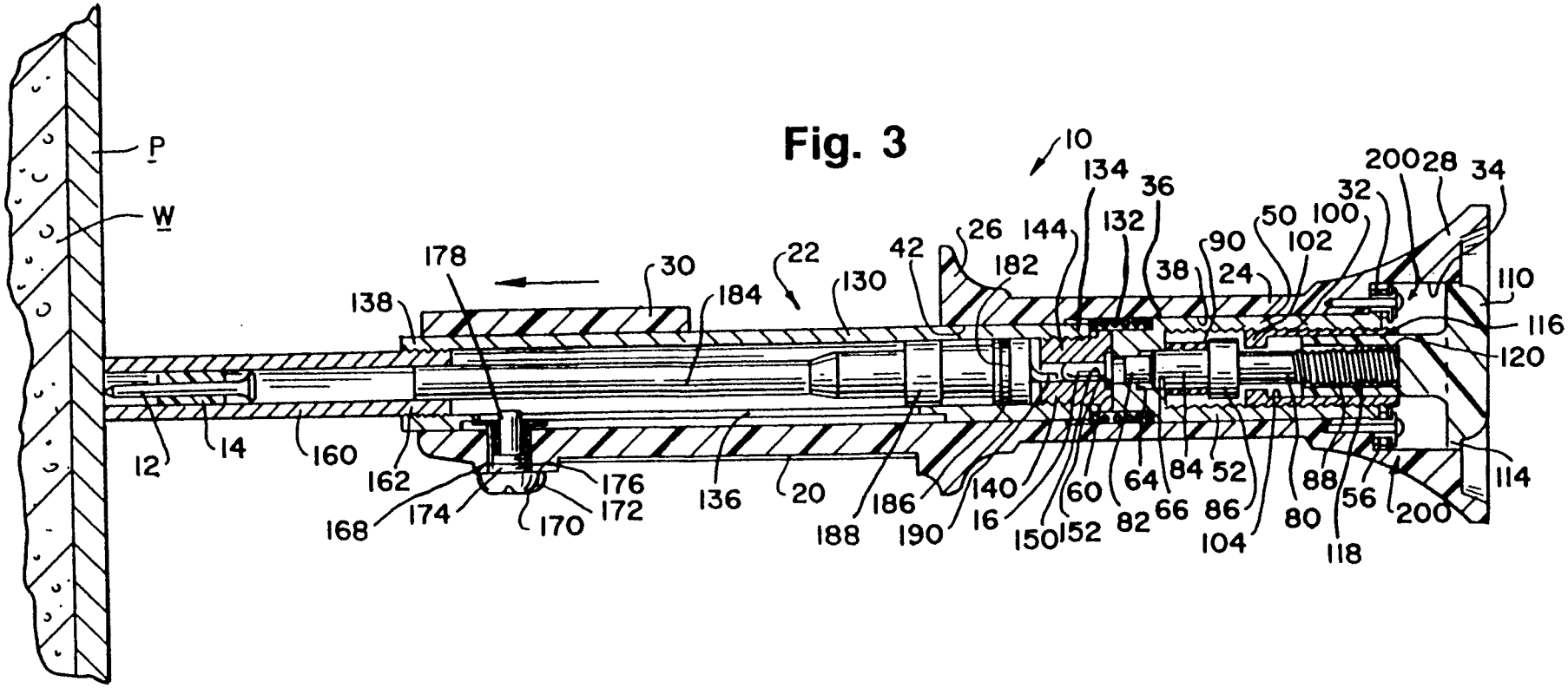
FIG. 3 is a longitudinal, sectional view similar to FIG. 1 but taken to show the tool in a pre-firing stage, after the barrel has been pressed against the metal workpiece with sufficient force to overcome the coiled spring and to move the barrel from the intermediate position to the retracted position.
Figures 4, 5, 6, 7, 8:
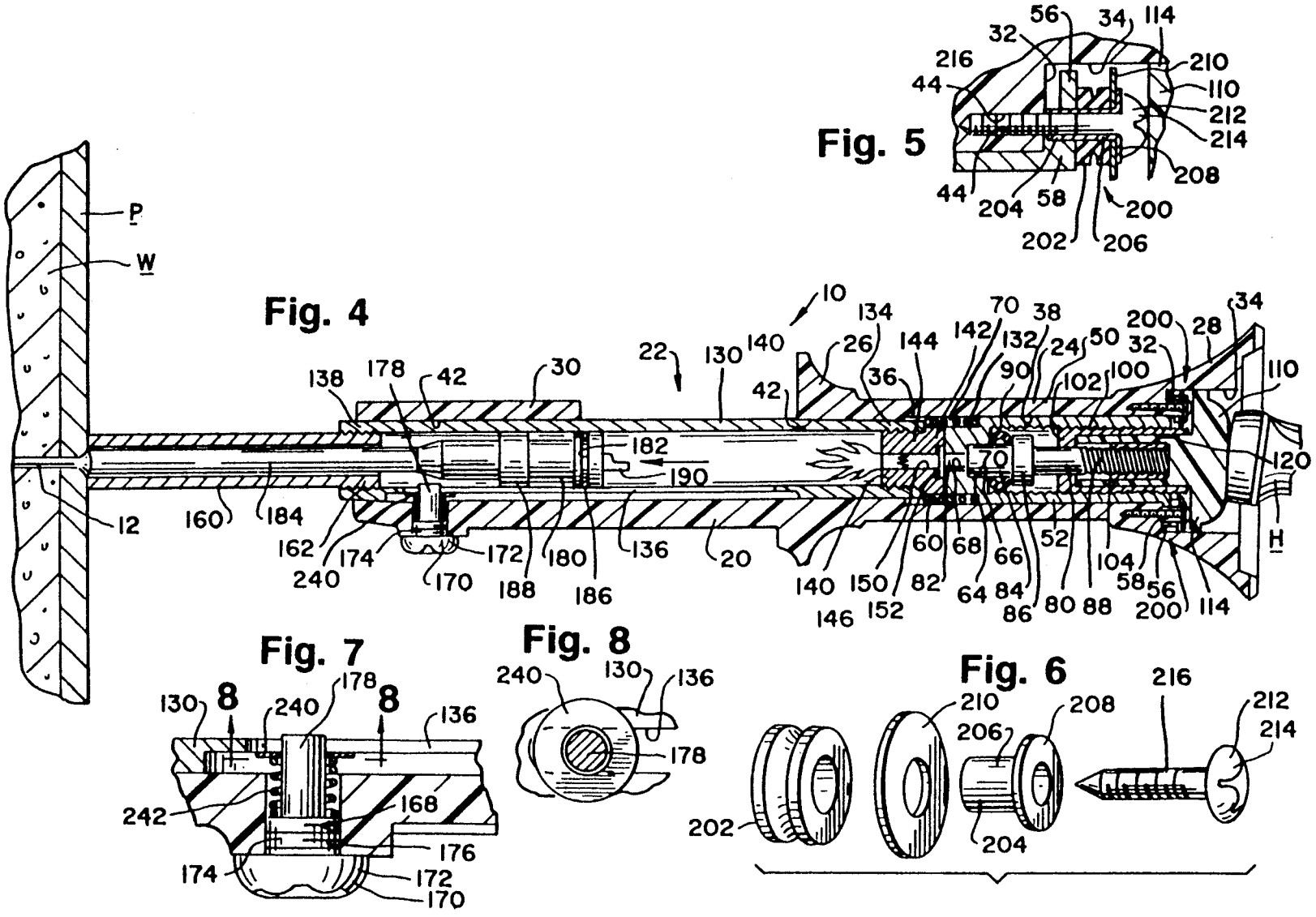
FIG. 4 is a longitudinal, sectional view similar to FIG. 2 but showing the tool in a firing stage, after the button has been struck with a hammer so as to cause the firing pin to fire the cartridge loaded into the tool.
FIG. 5 is an enlarged, fragmentary detail similar to FIG. 2 but showing the shock absorber structure in the firing stage of the tool.
FIG. 6 is a similarly enlarged, exploded, perspective view of the shock absorber structure.
FIG. 7 is an enlarged, fragmentary detail of a stud, an annular washer, and a coiled spring, which are used to,impart frictional drag on a barrel of the tool, as shown in FIG. 1.
FIG. 8 is a fragmentary, cross-sectional view taken along line 8—8 of FIG. 7, in a direction indicated by the arrows.

As shown in the drawings, a hammer-strikable, powder-actuated, fastener-driving tool 10 constitutes a preferred embodiment of this invention. The tool 10 derives its motive power from blank cartridges containing gunpowder. A drive pin 12, which is guided by a guidance flute 14, and a blank cartridge 16 are exemplified in FIGS. 1, 3, and 4. Preferably, the drive pin and guidance flute are similar to the drive pin and guidance flute disclosed in Van Allman et al. U.S. Pat. No. 4,979,858, the disclosure of which is incorporated herein by reference. The tool 10 is shown in FIGS. 1, 3, and 4 as used to drive a drive pin 12 through a steel plate P into a concrete wall W. As described in the Van Allman et al. patent noted above, the guidance flute 14 is broken away when the drive pin 12 is driven.

As shown in FIGS. 1, 3, and 4, the tool 10 includes a tool body 20, which is generally tubular, except for a lateral breech 22. The tool body 20 defines a longitudinal axis. The tool body 20 has a back portion 24, which defines a handle flared at its front end 26 and at its back end 28, and a front portion 30, which has the lateral breech 22. The back portion 24 has an annular wall 32 defining the front end of an outer, annular recess 34 of a relatively large diameter, an annular wall 36 defining the front end of a cylindrical cavity 38 of an intermediate diameter, and a cylindrical cavity 42 of a relatively small diameter. The cavity 42 extends from the annular wall 36, through the front portion 26. The lateral breech 22 opens into the cavity 42. The back portion 24 has four threaded sockets 44 (two shown) spaced circumferentially at approximately 90° intervals and opening backwardly at the annular wall 32.

The tool 10 includes a breech block 50, which is mounted within the tool body 20. The breech block 50 is not mounted fixedly therewithin but is mounted therewithin, as described below, so as to be axially movable over a relatively short range of breech block movement relative to the tool body 20.

The breech block 50 has a sleeve portion 52, which is disposed within the cylindrical cavity 38 so as to be axially movable therewithin over the aforenoted range. The sleeve portion 52 has an elongate, threaded socket 54 extending axially and opening backwardly. The breech block 50 has an annular flange 56, which has four similar holes 58 (two shown) spaced circumferentially at approximately 90° intervals. The annular flange 56, which extends radially from the sleeve portion 52, is disposed within the outer recess 34 so as to be axially movable therewithin over the aforenoted range. Near its front end 60, the breech block 50 has an inner, annular recess 64 having a cylindrical wall 66 and a central, cylindrical bore 68, which opens frontwardly from the recess 64, and an outer, annular recess 70.

A firing pin 80 is mounted within the breech block 50 so as to be axially movable over a range of firing pin movement relative to the breech block 50, between a dormant position and a firing position. As compared to the range of breech block movement, the range of firing pin movement is substantially longer. The firing pin 80 is shown in the dormant position in FIG. 1, and also in FIG. 3, and in the firing position in FIG. 4.

The firing pin 80 has a cylindrical tip 82, a cylindrical portion 84 behind the tip 82, a cylindrical boss 86 behind the cylindrical portion 84, and a partially cylindrical, partially threaded portion 88 behind the boss 86. The cylindrical portion 84 mounts a tubular, elastomeric sleeve 90, which is disposed axially between the inner shoulder 62 of the breech block 50 and the cylindrical boss portion 86. In the dormant position of the firing pin 80, the elastomeric sleeve 90 is not compressed axially therebetween, the cylindrical portion 84 extends partially into the recess 64, and the cylindrical tip 82 extends partially into the bore 68. In the firing position of the firing pin 80, the elastomeric sleeve 90 is compressed axially between the breech block shoulder 62 and the firing pin boss 86, as shown in FIG. 4.

An externally threaded, sleeve-like retainer 100 is threaded into the threaded socket 54 of the breech block 50. The retainer 100 has an annular, inwardly extending, front flange 102, which limits backward movement of the firing pin 80 relative to the retainer 100 and to the breech block 50. The retainer 100 has a cylindrical cavity 104 behind the flange 102.

A button 110, which is adapted to be forcibly struck by a hammer H, is connected to the firing pin 80 so as to be conjointly movable with the firing pin 80 relative to the breech block 50. The button 110 has a cylindrical margin 114, which fits movably within the annular recess 34, and a cylindrical stem 116, which has a cylindrical socket 118 opening frontwardly. An internally threaded insert 120 is molded into the cylindrical socket 118 and is threaded onto the partially threaded body portion 88 of the firing pin 80.

A tubular barrel or muzzle 130 is mounted within the cylindrical cavity 42 of the tool body 20 so as to be axially movable between a retracted position relative to the tool body 20 and an advanced position relative thereto. A coiled spring 132 is disposed within the tool body 20, between a back end 134 of the barrel 130 and within the annular recess 70 of the breech block 50, so as to oppose backward movement of the barrel 130 from an intermediate position to the retracted position. The barrel 130 is shown in the intermediate position in FIG. 1 and in the retracted position in FIGS. 3 and 4. The barrel 130 has an elongate, axially extending slot 136, which is diametrically opposite the lateral breech 22 of the tool body 20. Also, the barrel 130 has an internally threaded, front portion 138.

A barrel plug 140, having a hexagonal head 142 which is similar to the hexagonal head of a conventional bolt and a threaded stem 144, is connected to the back end 134 of the barrel 130. The barrel 130 has an internally threaded portion 146, which extends to its back end 134, and into which the threaded stem 144 is threaded. The barrel plug 140 has a cylindrical bore 150 and an annular recess 152 opening backwardly to accommodate a blank cartridge 16. It is possible to unload a spent cartridge 16 and to load a fresh cartridge 16 into the bore 150 and the recess 152, through the lateral breech 22 of the tool body 20, when the barrel 130 is moved sufficiently toward the advanced position. A tubular muzzle 160, which has an externally threaded portion 162 threaded into the internally threaded portion 138 of the barrel 130, extends axially and frontwardly from the barrel 130.

The tool body 20 has a threaded socket 168, near the threaded portion 138. A stud 170, which is mounted to the tool body 20, has a head 172 bearing against the tool body 20 and a shank 174. The shank 174 has a threaded portion 176, which is threaded into the threaded socket 168, and an unthreaded portion 178, which extends radially into the barrel 130, through the elongate slot 136. As shown in FIG. 7 and in other views, the threaded portion 176 has a relatively large diameter, and the unthreaded portion 178 has a relatively small diameter.

A piston 180, having an annular groove 182, and a driving blade 184, extending forwardly from the piston 180, are made in one piece and are mounted in the barrel 130 with an O-ring 186 seated in the groove 182. The O-ring 186 retains the piston 180 and the driving blade 184 frictionally in the barrel 130 but permits the piston 180 and the driving blade 184 to be axially moved within the barrel 130. The piece comprising the piston 180 and the driving blade 184 also has a cylindrical boss 188 near the piston 180. The unthreaded portion 178 of the shank 174 of the stud 170 is adapted to return the piston 180 back to the pre-firing position when the barrel 130 is moved axially forward. Also, the piston 180 has a probe 190, which extends backwardly. The probe 190 is adapted to eject a spent cartridge 16 partially from the bore 150 and the recess 152 of the barrel plug 140, when the barrel 130 is moved to the advanced position while the boss 188 engages the unthreaded portion 178 of the shank 179 so as to cause the piston 180 to be axially moved against the barrel plug 140 and the probe 190 to enter the bore 150.

In accordance with an important feature of this invention, the tool 10 includes a shock absorber structure comprising a plurality of shock absorber structures 200 (two shown) circumferentially spaced at 90° intervals.

Figure 2:
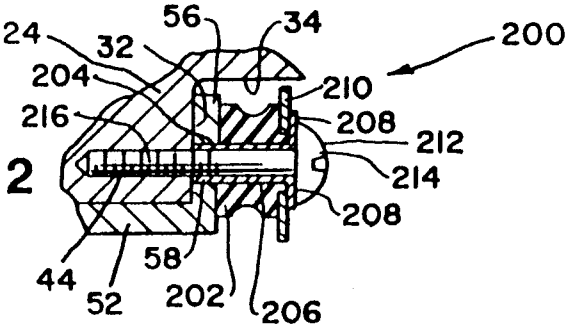
FIG. 2 is an enlarged, fragmentary detail of the shock absorber structure of the tool, as shown FIG. 1. The shock absorber structure is shown in the initial stage of the tool, before a button connected to a firing pin of the tool is struck forcibly by a hammer so as to cause the firing pin to fire a cartridge loaded into the tool.

As shown in FIGS. 2 and 5, each resilient structure 200 comprises an elastomeric grommet 202, an eyelet 204 having a tubular portion 206 and an annular portion 208, an annular washer 210, and a screw 212 having a head 214 and a threaded shank 216.

The tubular portion 206 of the eyelet 204 extends through an associated one of the holes 58 in the annular flange 56 of the breech block 50, against the annular wall 32 of the tool body 20, and engages the margin of an associated one of the threaded sockets 44 of the tool body 20. The elastomeric grommet 202 is disposed around the tubular portion 206 of the eyelet 204, between the annular portion 208 thereof and the annular flange 56. The annular washer 210 is disposed concentrically against the annular portion 208 of the eyelet 204. The screw 212 is mounted so that the shank 216 of the screw 212 is threaded into the associated socket 44, thereby through the elastomeric grommet 202 and the associated hole 58, and so that the head 214 of the screw 212 bears against the annular washer 210.

In each shock absorber structure 200, because the elastomeric grommet 202 is interposed between the head 214 of the screw 212 and the annular flange 56 of the breech block 50, such resilient structure 200 is arranged to resist backward movement of the breech block within the range of breech block movement when the tool 10 is fired. This action absorbs stresses imparted between the breech block 50 and the tool body 20 when a cartridge 16 loaded into the barrel plug 140 is fired by the firing pin 80. Thus, tool life is enhanced, and recoil imposed on the hand of the user is reduced.

As shown in FIGS. 7 and 8, an annular washer 240 is disposed around the unthreaded portion 178 of the stud 170 so as to bridge the elongate slot 136. A coiled spring 242 is disposed around the unthreaded portion 178 of the stud 170, between the threaded portion 176 thereof and the annular washer 240, so as to bias the annular washer 240 against the barrel 130. Because the annular washer 240 is biased against the barrel 130, the annular washer 240 imparts frictional drag on the barrel 130. Thus, although the barrel 130 continues to be axially movable toward and away from the breech block 50, frictional drag imparted by the annular washer 240 on the barrel 130 retards axial movement of the barrel 130 relative to the tool body 20.

Various modifications may be made in the preferred embodiment described above without departing from the scope and spirit of this invention. It is therefore to be understood that within the scope of the appended claims, the present invention may be practiced otherwise than as specifically described herein.

We claim:

1. A hammer-strikable, powder-actuated, fastener driving tool, comprising:

a tool body to be hand-held by a user and having a barrel mounted within a first front end of said tool body for housing a fastener to be driven;

charge means disposed within said tool body for propelling said fastener to be driven when said charge is fired;

a breech block mounted within said tool body such that said breech block is normally fixedly engaged with said tool body at a predetermined position whereby said breech block cannot undergo forward movement with respect to said tool body beyond said predetermined position but is capable of undergoing limited rearward movement with respect to said tool body;

firing pin means mounted within said tool body for actuation by a hammer blow so as to fire said charge means and cause said fastener to be driven from said tool;

rearwardly open recess means defined within a second rear end of said tool body;

means movably disposed within said rearwardly open recess means between an inoperative dormant position and an operating firing position, engaged with said firing pin means, and externally accessible through said rearwardly open recess means defined within said second rear end of said tool body, for receiving a hammer blow and thereby transmitting the force of said hammer blow to said firing pin means for firing said charge means and causing said fastener to be driven from said tool when said hammer blow causes movement of said means from said inoperative dormant position to said operative firing position; and shock absorbing means interposed between and in contact with both said tool body and said breech block, for resisting yet permitting said limited rearward movement of said breech block relative to said tool body and from said normal predetermined position so as to thereby absorb stresses imparted to said tool body when said tool is fired and thereby enhance tool life and reduce recoil imposed upon the hand of said user.

2. The subject matter of claim 1 wherein said shock absorbing means comprise a plurality of similar units disposed in circumferentially spaced relation within the tool and each engageable by the breech block.

3. A tool as set forth in claim 2, wherein:

each one of said similar shock absorbing units comprises an elastomeric grommet.

4. A tool as set forth in claim 3, wherein each one of said shock absorbing units comprises:

a screw having a threaded shank portion threadedly engaged within said tool body, and a head portion axially spaced from said tool body, a non-threaded shank portion of said screw extending through said breech block; and said elastomeric grommet is disposed around said non-threaded portion of said screw shank so as to be interposed between said screw head and said breech block.

5. A tool as set forth in claim 2, wherein:

said circumferentially spaced units comprise four units equiangularly spaced at 90° intervals with respect to each other.

6. A tool as set forth in claim 1, wherein:

a rear portion of said firing pin means is threaded; and said means movably disposed within said rearwardly open recess means for receiving a hammer blow comprises a button which is threaded for defining a threaded connection with said threaded rear portion of said firing pin means whereby said button is removable from said firing pin means and out from said rearwardly open recess means so as to provide access to said shock absorbing means disposed within said rearwardly open recess means.

7. A hammer-strikable, powder-actuated fastener-driving tool adapted to be fired so as to drive a fastener from said tool, comprising:

a generally tubular body having a portion defining a handle upon a first rear end section of said tubular body, and a barrel mounted within a second front end section of said tubular body for housing a fastener to be driven;

charge means disposed within said tubular body for propelling said fastener to be driven when said charge means is fired;

a breech block mounted within said tubular body such that said breech block is normally fixedly engaged with said tubular body at a predetermined position whereby said breech block cannot undergo forward movement with respect to said tubular body beyond said predetermined position but is capable of undergoing limited rearward movement with respect to said tubular body in response to firing said charge means;

firing pin means mounted within said breech block for axial movement toward a firing position in response to a hammer blow so as to fire said charge means and cause said fastener to be driven from said tool;

rearwardly open recess means defined within said first rear end section of said tubular body;

means, movably disposed within said rearwardly open recess means between an inoperative dormant position and an operative firing position, engaged with said firing pin means, and externally accessible through said rearwardly open recess means defined within said first rear end section of said tubular body, for receiving a hammer blow and thereby transmitting the force of said hammer blow to said firing pin means for firing said charge means and causing said fastener to be driven from said tool when said hammer blow causes movement of said means from said inoperative dormant position to said operative firing position; and shock absorbing means, interposed between and in contact with both said breech block and said tubular body, for resisting yet permitting said limited rearward movement of said breech block relative to said tubular body and from said normal predetermined position so as to thereby absorb stresses imparted to said tubular body when said tool is fired so as to thereby enhance tool life and reduce recoil imposed upon the hand of a user.

8. The tool of claim 7, wherein:

said means movable disposed within said rearwardly open recess means comprises a button adapted to be forcibly struck by a hammer and connected to said firing pin means so as to be conjointly movable with said firing pin means, and wherein further, said button is normally disposed at a position within said first rear end section said generally tubular body whereby said button can be forcibly struck by said hammer so as to impel said firing pin means to said firing position.

9. The tool of claim 7 wherein the shock absorbing means includes an elastomeric grommet.

10. The tool of claim 9 wherein the shock absorbing means includes a screw, which has a head and a shank, the shank extending through the elastomeric grommet and through a hole in the breech block and having a portion threaded into a threaded socket in the generally tubular body, the elastomeric grommet being interposed between the head and the breech block.

11. The tool of claim 10, wherein:

said shank of said screw comprises a non-threaded trailing portion defined between said threaded portion of said screw and said head of said screw, an eyelet having a tubular body portion surrounds said trailing portion of said screw, and said elastomeric grommet surrounds said tubular body portion of said eyelet.

12. The tool of claim 11 wherein the eyelet has an annular flanged portion interposed between the head of said screw and a rear end of the elastomeric grommet.

13. The tool of claim 12 wherein the resilient structure further includes an annular washer interposed between the annular flanged portion of the eyelet and the rear end of the elastomeric grommet.

14. A tool as set forth in claim 7, wherein:

a rear portion of said firing pin means is externally threaded; and said means movably disposed within said rearwardly open recess means for receiving a hammer blow comprises a button which has an internally threaded shank portion for threadedly engaging said externally threaded rear portion of said firing pin means whereby said button is removable from said firing pin means and out from said rearwardly open recess means so as to provide access to said shock absorbing means disposed within said rearwardly open recess means.

15. A tool as set forth in claim 7, wherein:

said shock absorbing means comprises a plurality of circumferentially spaced shock absorbing elastomeric grommet units equiangularly spaced with respect to each other at 90° intervals.

16. A hammer-strikable, powder-actuated, fastener-driving tool, comprising:

a generally tubular body defining a longitudinal axis, having a back portion defining a handle, and having a barrel mounted within a front portion of said tubular body for housing a fastener to be driven;

charge means disposed within said tubular body for propelling said fastener to be driven when said charge means is fired;

a breech block mounted within said generally tubular body, near the back end of said generally tubular body, such that said breech block is normally fixedly engaged with said tubular body at a predetermined position whereby said breech block cannot undergo forward movement with respect to said generally tubular body beyond said predetermined position but is capable of undergoing limited backward movement with respect to said tubular body in response to firing said charge means;

a firing pin mounted within said breech block so as to be axially movable over a range of firing pin movement relative to said breech block, said firing pin being biased so as to be normally disposed at a dormant position defined at a rear extreme of said range of firing pin movement, and being capable of being impelled forwardly by a hammer blow to a firing position defined at a forward extreme of said range of firing pin movement so as to fire said charge means and cause said fastener to be driven from said tool;

rearwardly open recess means defined within said back end of said generally tubular body;

a button movably disposed within said rearwardly open recess means between an inoperative dormant position and an operative firing position, connected to said firing pin so as to be conjointly movable with said firing pin, and externally accessible through said rearwardly open recess means defined within said back end of said generally tubular body such that said button can be forcibly struck by a hammer blow so as to impel said firing pin from said normal dormant position to said firing position whereby said firing pin can fire said charge means and cause said fastener to be driven from said tool; and a plurality of similar resilient shock absorber structures arranged circumferentially about said hammer-strikable button, each one of said shock absorber structures being interposed between and in contact with both said tubular body and said breech block for resisting yet permitting said limited backward movement of said breech block, relative to said tubular body and from said normal predetermined position so as to thereby absorb stresses imparted to said tubular body when said tool is fired and thereby enhance tool life and reduce recoil imposed upon the hand of a user.

17. A tool as set forth in claim 16, wherein:

a rear portion of said firing pin is externally threaded; and said button has an internally threaded shank portion for threadedly engaging said externally threaded rear portion of said firing pin whereby said button is removable from said firing pin and out from said rearwardly open recess means so as to provide access to said shock absorber structures disposed within said rearwardly open recess means.

18. A tool as set forth in claim 16, wherein:

each one of said similar resilient shock absorber structures comprises an elastomeric grommet.

19. A tool as set forth in claim 18, wherein each one of said shock absorber structures comprises:

a screw having a threaded shank portion threadedly engaged within said tubular body, a non-threaded shank portion extending through said breech block, and a head portion axially spaced from said breech block; and said elastomeric grommet is disposed around said non-threaded shank portion of said screw so as to be interposed between said screw head and said breech block.

20. A tool as set forth in claim 16, wherein:

said plurality of shock absorber structures comprises circumferentially spaced elastomeric grommet units equiangularly spaced with respect to each other at 90° intervals.

* * * * *